US006138944A

United States Patent [19]

McCowan et al.

[11] Patent Number: 6,138,944

[45] Date of Patent: Oct. 31, 2000

[54] SCATTERIDER GUIDANCE SYSTEM FOR A FLYING OBJECT BASED ON MAINTENANCE OF MINIMUM DISTANCE BETWEEN THE DESIGNATING LASER BEAM AND THE LONGITUDINAL AXIS OF THE FLYING OBJECT

[75] Inventors: Wayne L. McCowan, Guntersville; Alfred M. Wright, Toney; Cheryl S. Garrison; Robert R. Mitchell, both of Huntsville, all of Ala.

[73] Assignee: The United States of America as represented by the Secretary of the Army, Washington, D.C.

[21] Appl. No.: 09/310,675

[22] Filed: Apr. 16, 1999

[51] Int. Cl.[7] ..... F41G 7/26

[52] U.S. Cl. ..... 244/3.13; 244/3.1; 244/3.11

[58] Field of Search ..... 244/3.1, 3.11, 244/3.13, 3.15, 3.16, 3.17; 342/63, 62

[56] References Cited

U.S. PATENT DOCUMENTS 5,374,009 12/1994 Miller, Jr. et al. ..... 244/3.13

5,664,741 9/1997 Duke ..... 244/3.11

*Primary Examiner*—Bernarr E. Gregory

*Attorney, Agent, or Firm*—Arthur H. Tischer; Freddie M. Bush; Hay Kyung Chang

[57] ABSTRACT

The scatterider guidance system is mounted on the flying object that is to be guided toward a more direct impact on the selected target. The system utilizes a designating beam of laser pulses that is emitted from the launch pad toward the target and atmospheric particles that scatter the laser pulses to calculate the guidance commands that lead the flying object to follow the laser beam closely. Upon detection by the scatterider sensors of the laser light that is scattered by the atmospheric particles, the perpendicular radial distance between the laser beam and the longitudinal axis of the object in flight is calculated by the onboard guidance electronics and subsequently used to generate the deflection commands. The deflection commands, in turn, are used to deflect aerodynamic control surfaces of the object such that the object approaches and stays close to the laser beam. This guidance system is activated as soon after launch as possible and continues until the object impacts on the target.

11 Claims, 4 Drawing Sheets

SCATTERIDER GUIDANCE SYSTEM FOR A FLYING OBJECT BASED ON MAINTENANCE OF MINIMUM DISTANCE BETWEEN THE DESIGNATING LASER BEAM AND THE LONGITUDINAL AXIS OF THE FLYING OBJECT

DEDICATORY CLAUSE

The invention described herein may be manufactured, used and licensed by or for the Government for governmental purposes without the payment to us of any royalties thereon.

BACKGROUND OF THE INVENTION

Scatterider guidance system based on maintaining a minimum distance between the designating laser beam and the longitudinal axis of the flying object being guided relates to the area of technology that encompasses the use of laser designators to provide a guidance reference which is, in turn, utilized to guide the object to a designated target.

Extant guidance systems which use a laser designator to provide guidance signals to a flying object, such as a missile, employ either beamriding method or semi-active terminal seeking method. In the beamrider guidance, the missile flies inside the laser beam so that guidance information can be determined from laser scan pattern by one or more rear-looking detectors mounted on the missile. The scan pattern information is used on board the missile to calculate the guidance commands necessary to guide the missile to the center of the beam. Alternatively, the guidance commands can be calculated on the launch platform and received by the missile's rear-looking receiver or a wire link to guide the missile to the center of the beam. In the semi-active terminal seeker guidance, the seeker on board the missile detects the laser energy that is reflected from the target being designated by a laser designator. The seeker then outputs missile-to-target line-of-sight angles or angle rates to the guidance processor, also on board the missile, for use in calculating the guidance commands to guide the missile to the target.

Above-mentioned methods of missile guidance are adversely affected by environmental and battlefield obscurants such as rain, fog, clouds, smoke and chemical aerosol agents. These obscurants attenuate the energy of the laser proportional to range from the launcher and thereby reduce the effective range from the launcher at which a beamrider guided missile can successfully hit the target. The obscurants also reduce the range from a target at which a semi-active laser seeker can detect the laser energy reflected from the target. The reduced range, in turn, decreases the time available for the missile guidance system to correct missile heading errors after the target is detected, thus increasing the miss distance at the target. Also increased is the probability that when the missile does get within the degraded detection range from the target, the target will be outside the field of view of the seeker and will not be detected.

SUMMARY OF THE INVENTION

Prior to or simultaneously with the launch of the missile, laser pulses are emitted by a laser designator on the launch platform toward the selected target. Scatterider sensors mounted on the missile detect the laser light that is scattered by articles and molecules in the atmosphere. Then the perpendicular distance between the laser beam and the longitudinal axis of the missile in flight is calculated by the onboard guidance electronics and is subsequently used to generate the deflection commands which, in turn, are used to deflect aerodynamic control surfaces to steer the missile such that the missile approaches and stays close to the laser beam. This guidance system is initiated as soon after launch as possible and remains active until the missile impacts on the target.

DESCRIPTION OF THE PREFERRED EMBODIMENT

Figure 1:
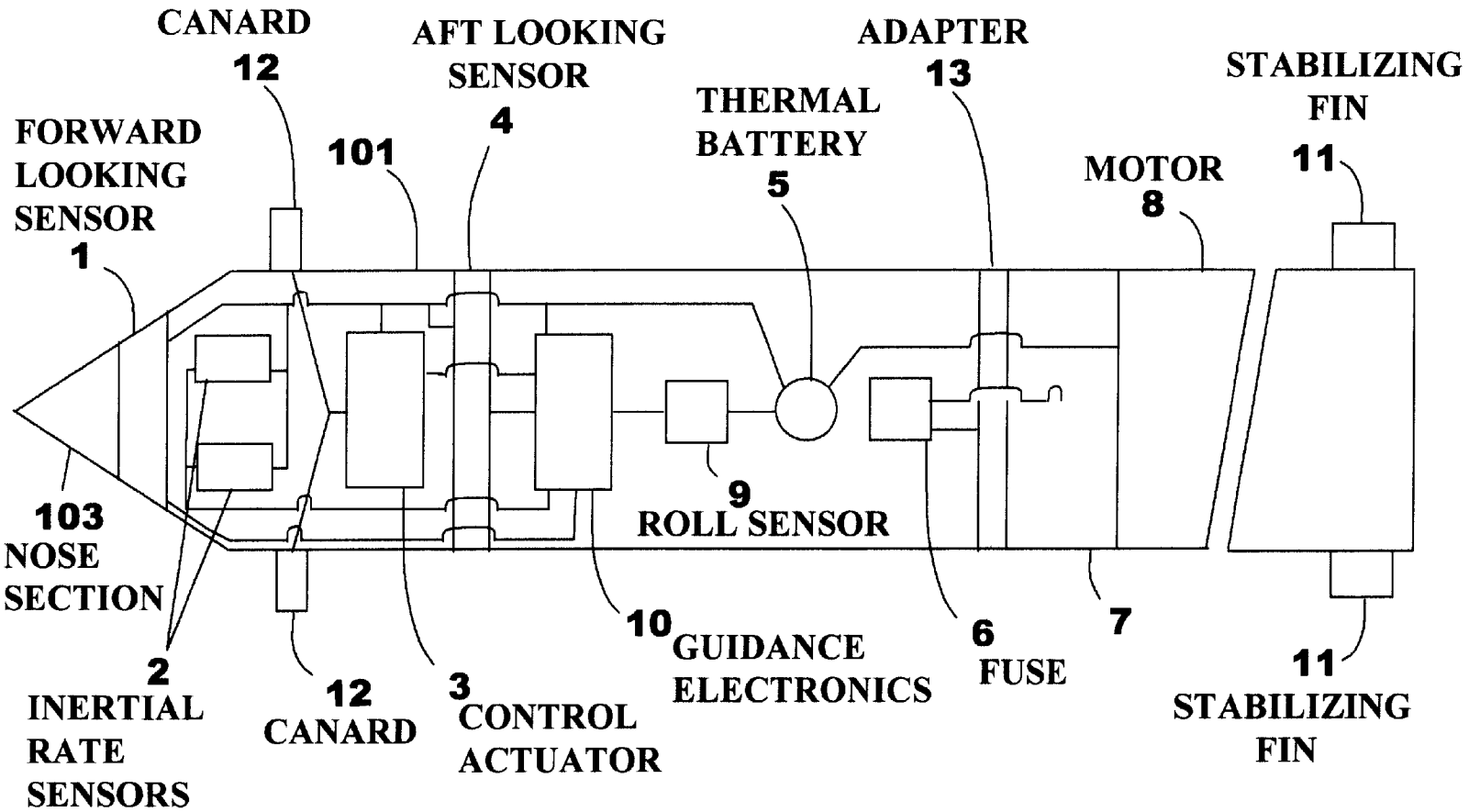
FIG. 1 is a diagram of a preferred embodiment of the scatterider guidance system in accordance with the invention.

Referring now to the drawing wherein like numbers represent like parts in each of the several figures, FIG. 1 schematically shows the components that comprise the scatterider guidance system according to the invention.

A prime candidate to be outfitted with the scatterider guidance system as hereinafter described (henceforth referred to as the "scatterider") is the Hydra 70 ballistic rocket. As indicated in FIG. 1, the rocket has a motor 8 that includes the propellant and the nozzle through which the combustion products exit the motor, stabilizing fins 11, fuse 6 and warhead 7. When the missile intercepts the designated target, the force generated along the missile longitudinal axis by the impact with the target initiates the fuse which, in turn, detonates the warhead. Leading the missile toward such an interception is performed by the scatterider.

Prior to being fired, the scatterider-guided missile 101 is contained in a launch pod that is attached to a launch platform. When the gunner deems it advisable to fire the missile at a target, he points the laser designator at the target and activates the laser beam. Upon activation, the laser designator emits a stream of laser light pulses at a pre-set repetition frequency. When the gunner pushes the fire button, a signal is sent over the electrical interface which connects the missile to the launch platform. This signal initiates the operation of thermal battery 5 which provides power to guidance electronics 10, and also powers up inertial rate sensors 2 and roll sensor 9. A squib (not shown in FIG. 1) ignites motor 8 and thereupon missile 101 is propelled out of the launch pod. When the section of the missile containing canards 12 clears the launch pod, the four canards mounted around the: circumference of the missile are released from their stowed position and allowed to open out into the air stream. When the aft end of the missile clears the launch pod, stabilizing fins 11 open out into the air stream and provide aerodynamic stability to the missile. The missile's scatterider guidance system is initiated 0.5 seconds after boost motor ignition. This time delay of 0.5 seconds between motor ignition and initiation of active guidance is necessary because the canards are aerodynamic control surfaces and the missile must first build up sufficient forward velocity (dynamic pressure) to enable canards 12 to maneuver the missile effectively. The active guidance thus begun lasts until the missile impacts on the target.

Active guidance consists of quickly steering the missile towards the laser beam, to within the radius from the beam necessary to achieve the required system accuracy, and maintaining the missile within this radial distance from the beam until the missile intercepts the target. The quickness with which the missile must be steered to within this necessary radius from the beam is a function of the maneuverability of the airframe of the missile and the minimum range from the launch platform at which it is desired to intercept the target.

Figure 2:
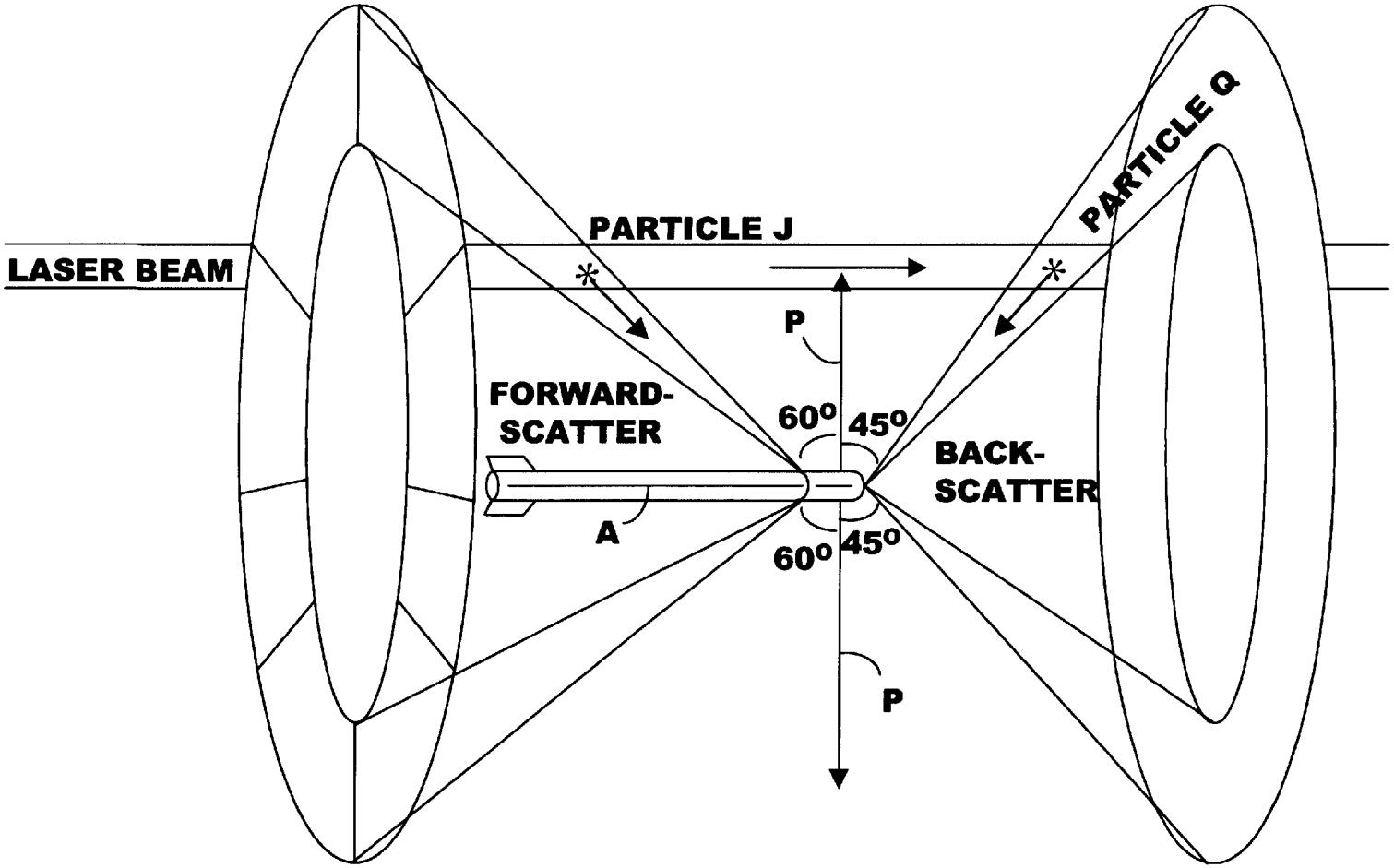
FIG. 2 illustrates the positioning of the aft-looking and forward-looking sensors on missile 101.

A necessary ingredient for proper performance of the scatterider are the naturally occuring particles and molecules in the atmosphere that scatter light. During the flight of missile 101, the laser light scattering from these particulates from a laser pulse is detected by eight aft-looking optical sensors 4 mounted around the circumference of the missile body and one annular forward-looking sensor 1 mounted on nose section 103 of the missile. The aft-looking sensors are mounted with their centerlines angled such that they point 60 degrees aft of the perpendicular, P, to the missile longitudinal axis, A, as illustrated in FIG. 2. These sensors detect the laser light that is scattered in a forward direction (i.e. in the direction of the missile flight) from a given laser pulse. Each of eight aft-looking sensors 4 has a field-of-view of 45 degrees. So, taken together, the eight sensors provide a 360-degree coverage around the missile for detection of forward-scatter laser light. The field-of-view for detection of back-scatter laser light is provided by one annular forward-looking sensor 1 which is mounted such that it "stares" at a 45-degree angle forward of the perpendicular, P, to the missile longitudinal axis, A. This annular sensor detects the laser light that is back-scattered from a given laser pulse. The aft-looking sensors and the forward-looking sensor may be contained in a compact module.

When light scattered from a laser pulse is detected by one of eight aft-looking sensors 4 and by forward-looking sensor 1, this detection event as well as the time lapse between the detection by the aft-looking sensor and the detection by the forward-looking sensor of the scattering light from the same laser pulse is input to guidance electronics 10. In response, the guidance electronics, which may be a digital computer and which is further coupled to the aft-looking sensors to derive which particular one of the eight aft-looking sensors actually detected the scattering light, calculates the radial distance, R, between the laser beam and the guided missile, using principles of geometry and trigonometry.

Figure 3:
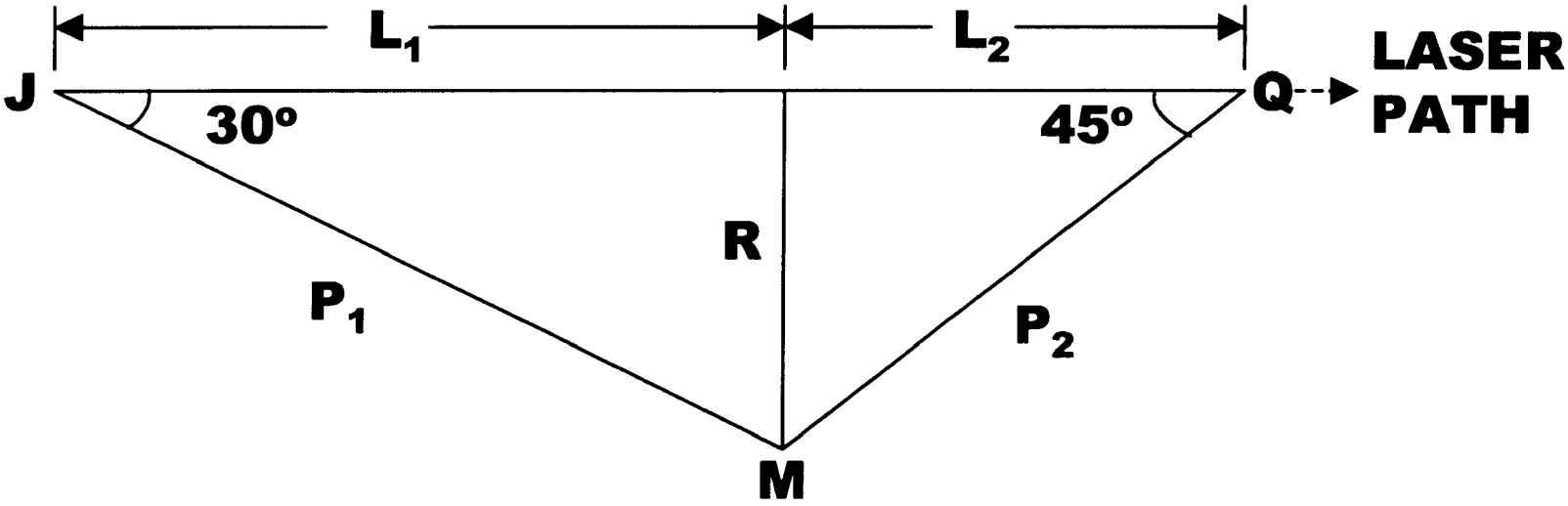
FIG. 3 shows the geometric relationship between the laser beam and the longitudinal axis, A, of the missile.

FIG. 3 illustrates the trigonometric calculation. As a way of further explanation, it is noted that light that is forward-scattered from a laser pulse when the pulse is at point (*) J travels path $P_1$ to reach an aft-looking sensor 4 at point M designating the position of missile 101. However, before forward-looking sensor 1 can detect light that is back-scattered from the same pulse, the pulse must first travel to the location of point Q. For sake of simplicity, it is assumed that the longitudinal axis of the missile and the laser path are parallel. Since the laser designator pulse repetition frequency is pre-set and is typically less than or equal to 20 Hz, the smallest time difference between two consecutive laser pulses is 0.05 second. During a time interval of 0.05 seconds, a pulse of laser light can travel a distance of about fifteen million meters. Hence, during any detection possibility associated with a laser pulse passing by missile 101, there is only one laser pulse at a time traversing the path length from point J to point Q. Thus, there is no possibility that one pulse can be detected by the forward-looking sensor 1 at the same time that the next emitted pulse is detected by an aft-looking sensor 4.

The difference in path lengths traveled by the forward-scattered and back-scattered light from the same laser pulse is a function of the radial distance, R, between the missile and the laser beam and the aforementioned mounting angles of the sensors. Since the speed of light is finite (about one foot per nanosecond), there is a measurable time delay between the arrival of the forward-scattered light at an aft-looking sensor 4 and the arrival of the back-scattered light at forward-looking sensor 1. As shown in FIG. 3, the leading edge of the laser pulse at some time, $T_1$, is at point J. Some time later, at $T_2$, the leading edge of the laser pulse has moved a distance given by the sum of the path lengths $L_1$ and $L_2$ and is at point Q. The missile and, hence, the sensors are at point M which is at some perpendicular distance, R, from the laser beam. The forward-scattered light travels from the laser pulse at point J via path $P_1$ to an aft-looking sensor 4 on the missile at point M. The back-scattered light travels from the laser pulse at point Q via path $P_2$ to the forward-looking sensor 1 on the missile at point M. The total path length traveled by the laser light that reaches the forward-looking sensor 1 is equal to the sum of the lengths of paths $L_1$, $L_2$ and $P_2$. The time delay between the detection of the forward-scattered light and the back-scattered light is a function of the speed of light and of the difference between the total path length given by $L_1+L_2+P_2$ and path length $P_1$.

From trigonometry, the following equations can be defined:

$$L_1=R/\ \mathrm{Tan}\ (30°)=1.732R \quad (1)$$

$$L_2=R/\ \mathrm{Tan}\ (45°)=R \quad (2)$$

$$P_1=R/\ \mathrm{Sin}\ (30°)=2.0R \quad (3)$$

$$P_2=R/\ \mathrm{Sin}\ (45°)=1.414R \quad (4)$$

The total path length traveled by the back-scattered light is given by $$L_1+L_2+P_2=(1.732+1.0+1.414)R=4.146R \quad (5)$$

The time delay between the detection of the forward-scattered light and the back-scattered light is the time it takes the light to travel a distance equal to the difference between the path length given by Equation (5) and the path length given by Equation (3):

$$\Delta T=(L_{1+}L_2+P_2-P_1)/c \quad (6)$$

$$\text{with } c=3(10^8)\ \text{meters/second} \quad (7)$$

Substituting Equations (3), (5) and (7) into Equation (6) gives $$\Delta T=(1.732+1.0+1.414-2.0)R/3(10^8)=7.153333(10^{-9})R \quad (8)$$

and the radial distance R between the missile and the laser beam path is found from Equation (8) to be given by $$R=\Delta T/7.153333(10^{-9})=1.39795(10^8)\Delta T\ \text{meters} \quad (9)$$

Figure 4:
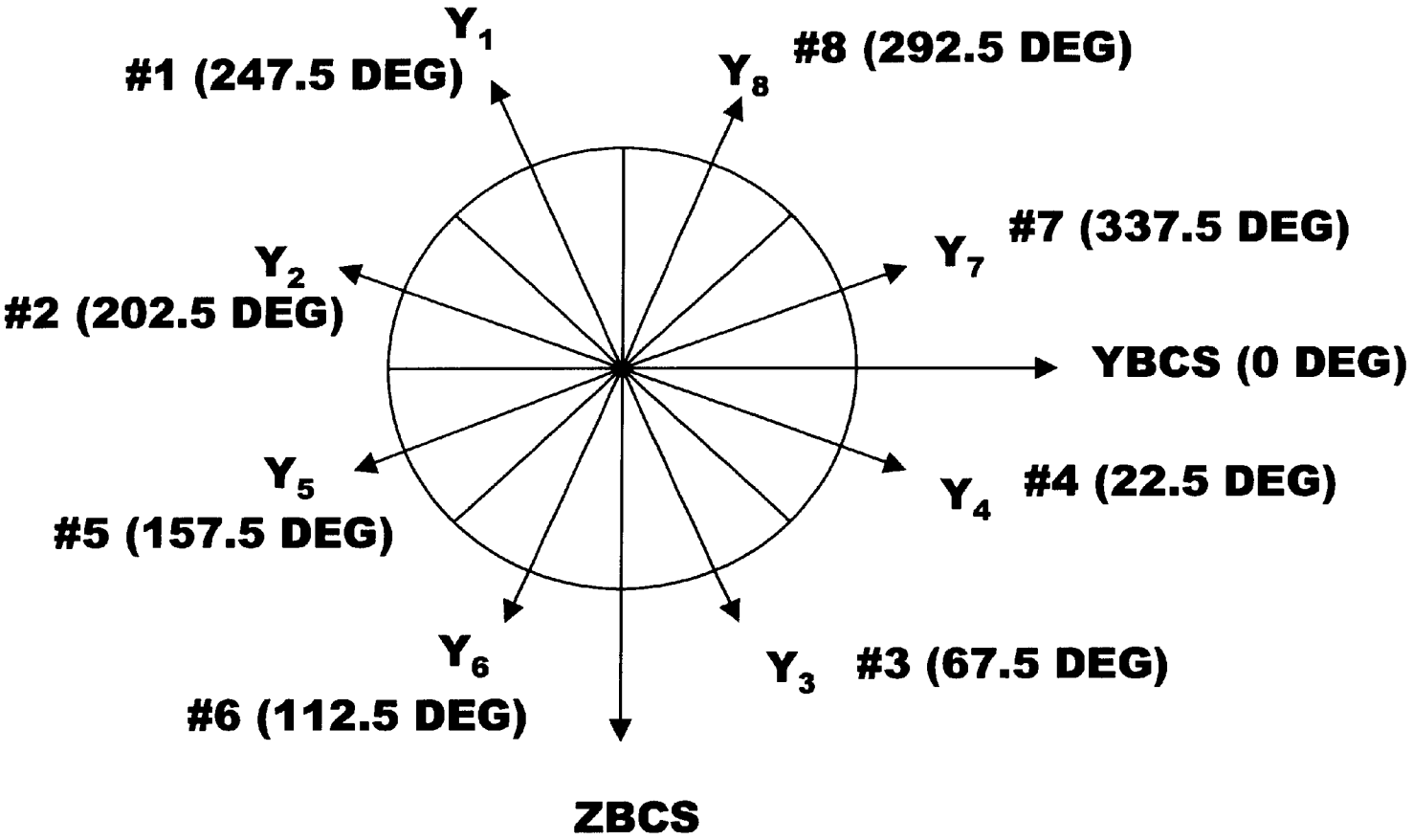
FIG. 4 shows a view of the eight aft-looking sensors from the aft end of the missile looking forward.

With the detection time difference measured by guidance electronics 10, the radial distance between the missile and the laser beam path can be determined with the simple calculation shown in Equation (9). The output of Equation (9) yields the magnitude of the relative range vector but not its angular orientation with respect to the missile's axis. For use in calculating guidance commands, the relative range vector (magnitude and direction) must be specified with respect to the longitudinal axis of the missile. The vector's direction is set by the location of the particular aft-looking sensor that actually detected the forward-scattered light. An aft-looking sensor cannot specify where in its field-of-view a laser pulse was detected, but only that one was detected. The relative range vector is, therefore, specified as lying along the centerline of the detecting sensor as depicted in FIG. 4. The information regarding the magnitude of the relative range vector and the vector direction allows the calculation of the components of the relative range vector along the longitudinal axis of the missile, yaw axis and pitch axis for use in generating the guidance commands.

The foregoing description of the workings of the scatterider guidance system is based on the assumption that the designator laser beam path and the longitudinal axis of the missile remain parallel to each other. In actual practice, however, the longitudinal axis and the laser path will not always be parallel, that is, the missile in flight usually has a non-zero angle of attack. This means that the radial distance R will not always be perpendicular to the laser path and the calculated distance R resulting from use of Equation (9) would be in error. But it is simple to calculate a correction factor, as a function of the missile's angle of attack, from the changes that ensue in the geometry presented in FIG. 3. This correction factor can be stored in memory of the guidance electronics and an estimate of the missile's angle of attack maintained during the flight from which an appropriate correction can be applied to the output of Equation (9).

Associated with the scatterider guidance system is a circular deadzone or null guidance zone in the center of the designating laser beam. If the missile is within this deadzone, the sensors will not function properly because the laser beam essentially surrounds the missile and all of the sensors simultaneously detect the pulses. However, it matters not whether the sensors function because when the missile is within the deadzone, it follows that the missile is flying within the beam toward impact with the target.

In the event that an aft-looking sensor 4 detects laser light but forward-looking sensor 1 does not, information as to which particular aft-looking sensor detected the pulse specifies the direction to the pulse relative the longitudinal axis, A, of the missile. The basis for the assumed direction is illustrated in FIG. 4 where $Y_n$ denotes the centerline of the nth sensor. The radial distance, R, to the laser beam is estimated as the midpoint distance between the maximum detection ranges of aft-looking sensors 4 and forward-looking sensor 1.

Once the beam direction and measured distance or estimated distance are known, the data is used by the guidance electronics 10 to calculate the lateral acceleration command which is required to steer the missile toward the laser beam path. This command is further processed by the guidance electronics with the missile pitch and yaw rotational rate measurements input thereto by inertial rate sensors 2 and the roll attitude angle measurement from roll sensor 9 to yield deflection command. The deflection command is then input to control actuator 3 which, in response, generates the torque necessary to deflect canards 12 by the amount required to bring the missile to within the desired radial distance from the designating laser beam path and causes the canards to deflect accordingly.

The guidance that begins with the detection of laser pulses by the sensors and proceeds to output of the canard deflection commands continues until the missile intercepts the designated target. The frequency at which the sensors can detect the laser pulses is no greater than, but may be less than, the rate at which the laser designator emits the laser pulses. Each time a pulse is sensed, guidance commands are generated. Therefore, the frequency at which the guidance commands are generated is the same as the frequency at which the sensors detect the laser pulses.

Although a particular embodiment and form of this invention has been illustrated, it is apparent that various modifications and embodiments of the invention may be made by those skilled in the art without departing from the scope and spirit of the foregoing disclosure. One such modification may be adapter 13 which enables a retrofit package containing the scatterider guidance system to be installed into an existing unguided missile to render the missile capable of more accurate impact with the designated target. Accordingly, the scope of the invention should be limited only by the claims appended hereto.

We claim:

1. A scatterider guidance system for guiding a flying object toward a more direct impact on a target, the flying object having a longitudinal axis, a nose section, a flight motor and at least one stabilizing fin, said scatterider guidance system being mounted on the flying object and co-operating with a beam of laser pulses emitted at a pre-set repetition frequency from a laser designator toward the target and further co-operating with atmospheric particles, said scatterider guidance system comprising: a means for detecting laser light scattering from the particles; a means for receiving said detected laser light and, in response thereto, calculating the perpendicular distance between the laser beam and the longitudinal axis of the flying object; a means for steering the flying object to within a pre-determined perpendicular distance from the laser beam; and a control actuator, said actuator being coupled to receive the calculated distance from said calculating means and generate guidance commands and subsequently input said guidance commands to said steering means such that the flying object flies toward a more direct impact on the target.

2. A scatterider guidance system for guiding a flying object as set forth in claim 1, wherein said laser light detecting means comprises a forward-looking sensor to detect back-scattered laser light scattering from the atmospheric particles and a plurality of aft-looking sensors to detect forward-scattered laser light scattering from the atmospheric particles.

3. A scatterider guidance system for guiding a flying object as set forth in claim 2, wherein said forward-looking sensor is an annular laser detector mounted on the nose section of the flying object so as to stare at a 45-degree angle forward of the perpendicular to the longitudinal axis of the flying object.

4. A scatttrider guidance system as set forth in claim 3, wherein said plurality of aft-looking sensors comprises at least eight laser detectors, each having a field-of-view at most of 45 degrees, said multiple detectors being mounted behind the nose section of the flying object such that they stare at a 60-degree angle aft of the perpendicular to the longitudinal axis while jointly providing a 360-degree field-of-view around the flying object.

5. A scatterider guidance system as set forth in claim 4, wherein said calculating means comprises guidance electronics coupled to said aft-looking and forward-looking sensors, said guidance electronics being capable of distinguishing the particular aft-looking sensor on which scattered laser light from a given laser pulse is incident, said guidance electronics having therein a means for computing radial distance between the laser beam path and the longitudinal axis of the flying object and generating lateral acceleration commands required to steer the flying object toward the laser beam so as to reduce said radial distance to within a pre-determined value.

6. A scatterider guidance system as set forth in claim 5, wherein said guidance electronics is capable of measuring the time differential between the detection of scattered light from a given laser pulse by said forward-looking sensor and the detection of scattered light from the same laser pulse by said aft-looking sensors, the given laser pulse scattering from a multiplicity of atmospheric particles, said particles being separated from each other by a random distance.

7. A scatterider guidance system as set forth in claim 6, wherein said guidance electronics comprises a digital signal processor.

8. A scatterider guidance system as set forth in claim 7, wherein said steering means comprises at least two deflectable canards mounted onto the flying object.

9. A scatterider guidance system as set forth in claim 8, wherein said system further comprises at least one inertial rate sensor for measuring the pitch and yaw rotational rate of the flying object and a roll sensor for measuring the roll attitude angle of the object, said measurements from said inertial rate sensor and said roll sensor being input to said guidance electronics.

10. A scatterider guidance system as set forth in claim 9, wherein said guidance electronics further contains therein a means for receiving said lateral acceleration commands from said computing means and processing said lateral acceleration commands with said pitch, yaw and rotational measurements to yield canard deflection commands and inputting said deflection commands to said control actuator, said actuator, in response, producing the torque required to deflect said canards in accordance with said deflection commands.

11. A scatterider guidance system as set forth in claim 10, wherein said system still further comprises a thermal battery, said battery being coupled to empower said guidance electronics, inertial rate sensor and roll sensor upon receipt of a launch signal.

* * * * *